US010519721B2

(12) United States Patent
Williams

(10) Patent No.: US 10,519,721 B2
(45) Date of Patent: Dec. 31, 2019

(54) NESTED BEARING AND SEAL FOR ROLLER CONE DRILL BIT

(71) Applicant: Halliburton Energy Services, Inc., Houston, TX (US)

(72) Inventor: Mark E. Williams, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 15/561,617

(22) PCT Filed: Apr. 27, 2015

(86) PCT No.: PCT/US2015/027746
§ 371 (c)(1),
(2) Date: Sep. 26, 2017

(87) PCT Pub. No.: WO2016/175739
PCT Pub. Date: Nov. 3, 2016

(65) Prior Publication Data
US 2018/0073302 A1 Mar. 15, 2018

(51) Int. Cl.
*E21B 10/25* (2006.01)
*E21B 10/22* (2006.01)

(52) U.S. Cl.
CPC ..... *E21B 10/25* (2013.01); *E21B 10/22* (2013.01)

(58) Field of Classification Search
CPC ..... E21B 10/25; E21B 10/22
USPC ..... 175/371, 372
See application file for complete search history.

(56) References Cited

U.S. PATENT DOCUMENTS

| | | | | |
|---|---|---|---|---|
| 2,005,547 | A | 6/1935 | Johnson | |
| 3,361,494 | A | 1/1968 | Galle | |
| 3,370,895 | A | 2/1968 | Cason, Jr. | |
| 4,235,480 | A | 11/1980 | Olschewski et al. | |
| 4,306,727 | A | 12/1981 | Deane et al. | |
| 4,320,929 | A | 3/1982 | Clark et al. | |
| 4,343,371 | A * | 8/1982 | Baker, III | E21B 10/14 175/336 |
| 4,484,754 | A | 11/1984 | Ballard | |
| 4,660,996 | A | 4/1987 | Marshall | |
| 4,750,847 | A | 6/1988 | Boyd | |
| 5,013,009 | A | 5/1991 | Nelson | |
| 5,383,525 | A * | 1/1995 | Daly | E21B 10/20 175/371 |
| 5,513,711 | A * | 5/1996 | Williams | E21B 10/25 175/337 |
| 5,570,750 | A * | 11/1996 | Williams | E21B 10/22 175/371 |
| 6,129,161 | A | 10/2000 | Roberts et al. | |
| 6,260,635 | B1 | 7/2001 | Crawford | |
| 6,474,424 | B1 | 11/2002 | Saxman | |

(Continued)

FOREIGN PATENT DOCUMENTS

| | | |
|---|---|---|
| CN | 2468653 | 1/2002 |
| WO | 2011/035051 | 3/2011 |

OTHER PUBLICATIONS

International Search Report and Written Opinion for PCT/US2015/027746, dated Jan. 11, 2016; 15 pages.

*Primary Examiner* — Michael R Wills, III
(74) *Attorney, Agent, or Firm* — Baker Botts L.L.P.

(57) ABSTRACT

The present disclosure relates to nested bearings and seals for use in roller cone drill bits. The bearing may include a bearing member, such as a flange or bushing, that is nested with a seal boss.

20 Claims, 9 Drawing Sheets

(56) References Cited

U.S. PATENT DOCUMENTS

| | | | | |
|---|---|---|---|---|
| 6,533,051 | B1 * | 3/2003 | Singh | E21B 10/08 175/365 |
| 8,020,638 | B2 | 9/2011 | Chellappa et al. | |
| 8,439,571 | B2 | 5/2013 | Proeschel | |
| 8,459,379 | B2 | 6/2013 | Sui et al. | |
| 8,534,389 | B2 * | 9/2013 | Gallifet | E21B 10/24 175/371 |
| 8,672,060 | B2 * | 3/2014 | Centala | E21B 10/08 175/336 |
| 8,764,307 | B2 | 7/2014 | Brubaker et al. | |
| 9,091,130 | B2 * | 7/2015 | Lebeck | E21B 10/25 |
| 2005/0103531 | A1 | 5/2005 | Byrd | |
| 2006/0231292 | A1 | 10/2006 | Lin et al. | |
| 2009/0194339 | A1 | 8/2009 | Dick et al. | |
| 2010/0163313 | A1 * | 7/2010 | Lin | E21B 10/22 175/371 |
| 2011/0315453 | A1 | 12/2011 | Crawford et al. | |

* cited by examiner

NESTED BEARING AND SEAL FOR ROLLER CONE DRILL BIT

RELATED APPLICATIONS

This application is a U.S. National Stage Application of International Application No. PCT/US2015/027746 filed Apr. 27, 2015, which designates the United States, and is incorporated herein by reference in its entirety.

TECHNICAL FIELD

The present disclosure relates to bearings and seals for use in roller cone drill bits.

BACKGROUND

Roller cone drill bits are used to form wellbores in subterranean formations. Such drill bits generally include one or more support arms with respective cone assemblies rotatably mounted on interior portions of each support arm. The cone assemblies rotate on bearings that are sealed to retain lubricant. The load on these bearings, particularly during bit use, can be quite high, resulting in damage to or failure of the bearings and associated seals or assemblies. In order to repair damaged or failed parts, the bit may have to be withdrawn from the wellbore, a time-consuming and expensive process.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION

The present disclosure relates to a roller cone drill bit containing a nested bearing and seal on at least one cone assembly and spindle. The disclosure and its advantages are best understood by reference to FIGS. 1-10 wherein like numbers refer to same and like parts.

A nested bearing and seal may be used in order to increase the contact area of bearing surfaces, while still providing a satisfactory seal. A nested bearing and seal according to the present disclosure may be used in a roller cone drill bit of FIG. 1 or a similar bit also containing at least one cone assembly and spindle as further illustrated in FIG. 2. With respect to FIGS. 1 and 2 roller cone drill bit 10 includes bit body 20 having tapered, externally threaded, upper portion 30 satisfactory for use in attaching roller cone drill bit 10 with a drill string (as further described with respect to FIGS. 9 and 10) to allow rotation of roller cone drill bit 10 in response to rotation of the drill string (as further described with respect to FIGS. 9 and 10).

Figure 1:
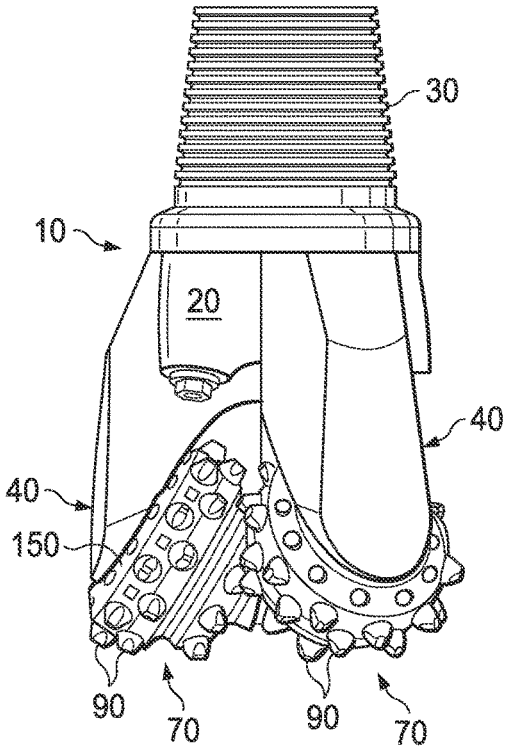
FIG. 1 is a schematic drawing in elevation showing a roller cone drill bit incorporating teachings of the present disclosure.
Figure 9:
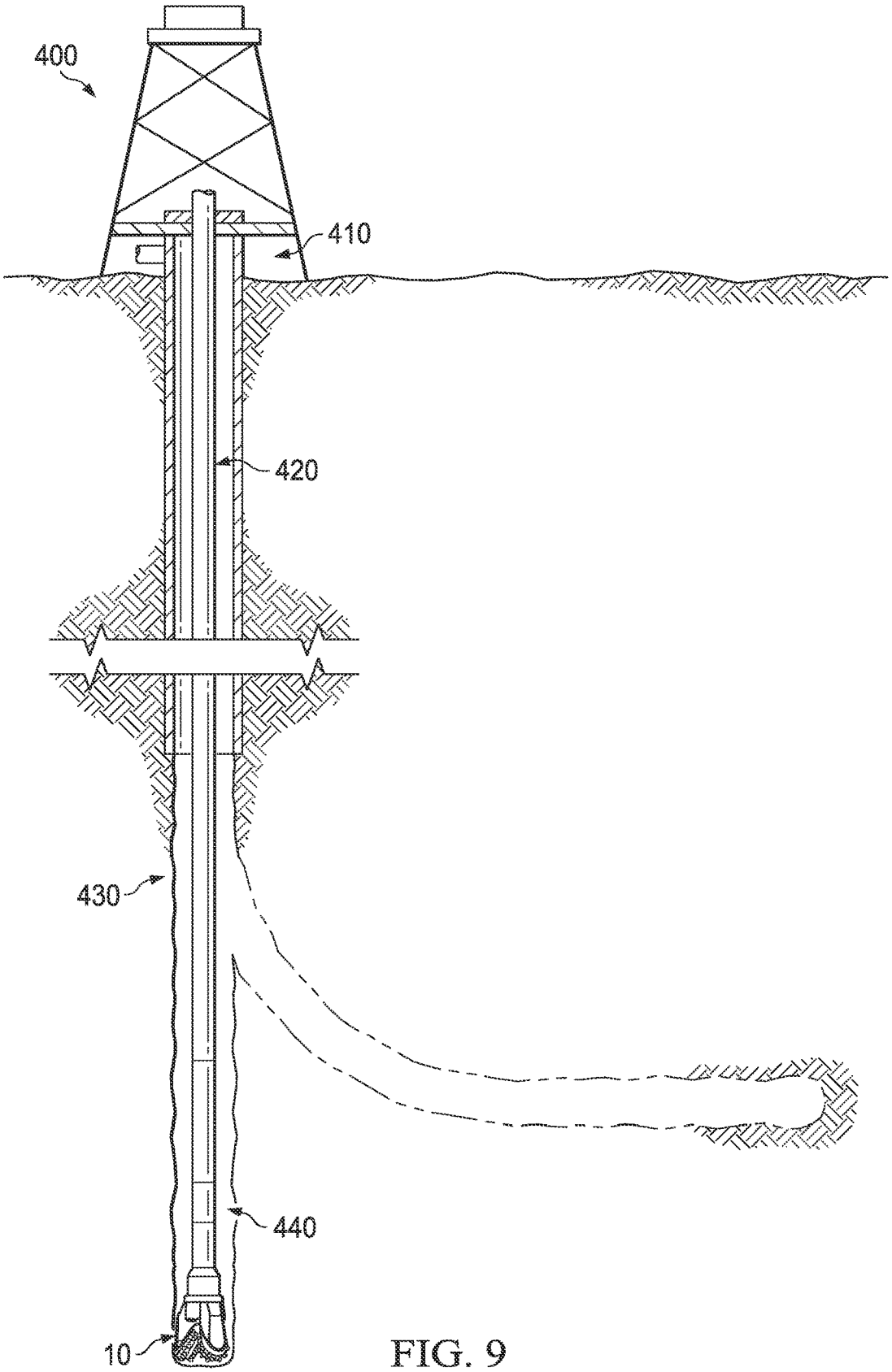
FIG. 9 is a schematic drawing in section and in elevation with portions broken away showing examples of wellbores which may be formed by a roller cone drill bit incorporating teachings of the present disclosure.
Figure 10:
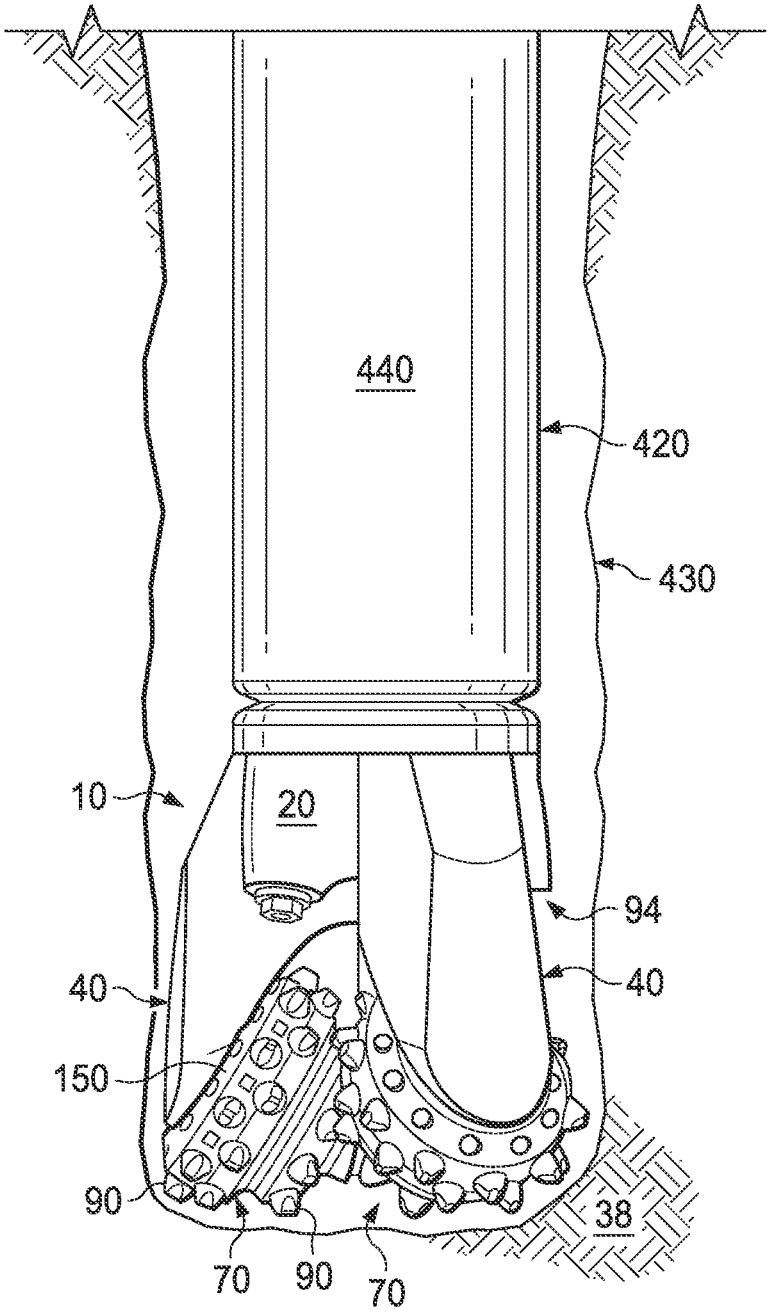
FIG. 10 is a schematic drawing in section and in elevation with portions broken away showing the drill string and attached roller cone drill bit of FIG. 9 adjacent to the bottom of a wellbore.

Bit body 10 may include support arms 40. Only two support arms 40 are shown in FIGS. 1, 9 and 10, but bit body 10 may include as few as one support arm 40 or more than two support arms 40, such as a plurality of support arms 40.

Each support arm 40 may include respective spindle 50 extending inwardly from associated interior surface 60. Cone assemblies 70 may be rotatably mounted on respective spindles 50 extending from each support arm 40. Each cone assembly 70 may include respective axis of rotation 80 extending at an angle corresponding generally with the angular relationship between associated spindle 50 and support arm 40. Spindles 50 may be angled downwardly and inwardly with respect to associated interior surfaces 60 to allow cone assemblies 70 to engage a formation to form a wellbore (such as wellbore 430 in FIG. 9) during use of roller cone drill bit 10. For some applications spindles 50 may be tilted at an angle of zero to three or four degrees in the direction of rotation of roller cone drill bit 10 during drill bit use. Cone assemblies 70 may include cutting elements 90 arranged to engage a formation to form a wellbore (such as wellbore 430 in FIG. 9) during use of roller cone drill bit 10.

Figure 2:
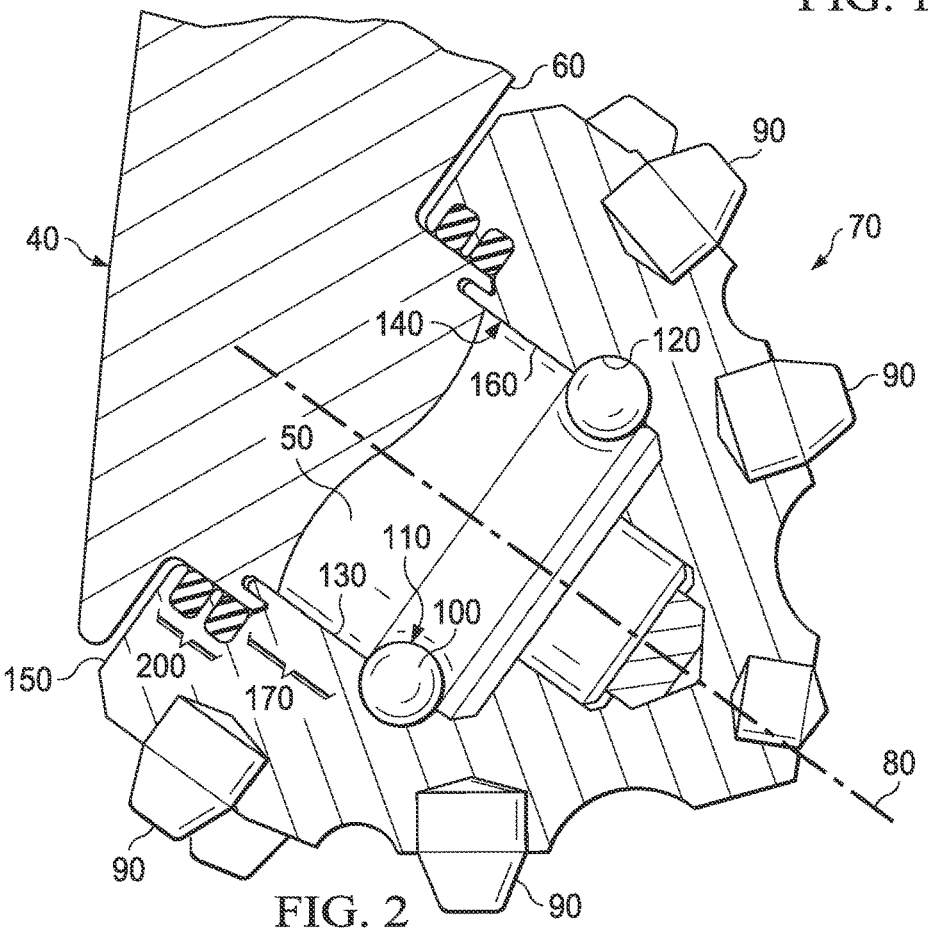
FIG. 2 is a schematic drawing partially in section and partially in elevation with portions broken away showing a support arm and cone assembly incorporating teachings of the present disclosure.

Details of how cone assembly 70 is rotatably mounted on spindle 50 are provided in FIG. 2. Similar configurations containing at least one bearing may also be used in conjunction with the nested bearing and seals of the present disclosure.

Various types of retaining systems and locking systems may be satisfactorily used to securely engage each cone assembly 70 with associated spindle 50. In FIG. 2, ball bearings 100 cooperate with ball races 110 and 120 formed on adjacent portions of spindle 50 and cone assembly 70 to prevent disengagement of cone assembly 70 from associated spindle 50.

Spindle 50 and cone assembly 70, as well as other components of roller cone drill bit 10 may be made from any suitable bit material, including conventional materials, such as steel.

Various types of bearings may be used to facilitate rotation of cone assembly 70 on associated spindle 50 around axis of rotation 80. For example, each spindle 50 may include generally cylindrical exterior surfaces such as bearing surface 130. Each cone assembly 70 may include a respective cavity 140 extending inwardly from associated backface 150. Each cavity 140 may include generally cylindrical interior surfaces such as bearing surface 160. The cylindrical portions of each cavity 140 may have a respective inside diameter which is generally larger than the outside diameter of an adjacent cylindrical portion of spindle 50. Variations between the inside diameter of each cavity 140 and outside diameter of associated spindle 50 are selected to accommodate the associated bearing 170 and allow rotation of each cone assembly 70 relative to associated spindle 50 and adjacent portions of support arm 40. The actual difference between the outside diameter of bearing surface 130 and the inside diameter of bearing surface 160 may be relatively small to provide desired bearing support or rotational support for each cone assembly 70 relative to associated spindle 50. Bearing surfaces 130 and 160 support radial loads resulting from rotation of cone assembly 70 relative to associated spindle 50.

The steel bearing surfaces may be treated to improve the wear resistance and/or anti-galling properties using methods such as heat treatment, bushings, coatings or hard metal inlays. Specifically, bearing surface 130 may include a hard metal inlay where load is most likely to be experienced during use. Bearing surface 160 may be plated with silver.

Roller cone drill bit 10 further includes a lubricant system to supply lubrication to various drill bit components, such as bearing surfaces 130 and 160 or ball races 110 and 120. The lubricant system may include any of a lubricant reservoir, lubricant pressure compensator and one or more lubricant passageways to provide lubrication to various components of associated spindle 50 and cone assembly 70.

Roller cone drill bit 10 may include at least one seal 200 engaged with exterior portions of spindle 50 and interior portions of cavity 140 located between bearing surfaces 130 and 160 and interior surface 60 of associated support arm 40. Seal 200 may be used to block the flow of exterior fluids from communicating with bearing surfaces 130 and 160 and ball races 110 and 120 Seal 200 may also form a fluid barrier to prevent lubricant from exiting drill bit 10. Seal 200, thus may protect associated bearings 170 from loss of lubricant and from contamination with debris or exterior fluids and prolong the downhole drilling life of roller cone drill bit 10.

For some applications seal 200 may include a seal ring or packing disposed in a seal gland. Although FIG. 2 illustrates a bit with one seal 200 and a single seal gland, two or more seal glands may be used, particularly with larger bits. Embodiments with two or more seal glands are further described with respect to FIGS. 3-6.

Although both bearings, such as bearing 170, and seals, such as seal 200, facilitate the operation of roller cone drill bit 10, they are located in a similar location and conventionally compete with one another for limited space. Typically, the seal constrains the size of bearings and bearing surfaces because the seal occupies space between spindle 50 and cone assembly 70. Within the size constraints otherwise imposed by the roller cone drill bit, any increase in bearing size is beneficial because it allows the bearing to better distribute forces placed upon it during use of the bit.

According to the present disclosure and as illustrated in the examples of FIGS. 3-8, seal 200 and bearing 170 may be designed to increase the contact area of bearing surfaces 130 and 160, while still providing a satisfactory seal by seal 200. As illustrated in FIGS. 3-8, seal boss 210*a* or 210*b* extends partially over a contact area where bearing surfaces 130 and 160 arc in contact with one another. This extension is made possible by a bearing member, such as flange 180 or bushing 190*a*, which nests with seal boss 210*a* or 210*b* and increases the overall area of the contact area between bearing surfaces 130 and 160 as compared to what it would be in a similar drill bit with a seal boss that did not nest with a flange. The increased contact area of bearing surfaces 130 and 160 increases load capacity and/or effectiveness of bearing 170. The use of a bearing member, such as flange 180 or bushing 190*a* at an edge of bearing 170 also provides increased flexibility and decreased rigidity of bearing 170, which increases the ability of bearing 170 to reduce high contact stresses commonly found at the edges of bearings, particularly as the bearing tilts during erratic load conditions common in drilling. The cones 70 on a roller cone drill bit 10 are particularly susceptible to edge loading because the interaction between the cutting elements 90 and the bottom of the wellbore 430 cause the cone 70 to tilt, resulting in misalignment between the axis of the spindle and the cone bearing axis 80. This results in the bearing load occurring over a small contact area at the bearing edge and high contact stresses. In particular, flange 180 or bushing 190*a* may deform slightly in response to contact stresses, distributing the stress over a larger area and decreasing its maximum value. This results in less wear and heat generation, which is particularly problematic near seal 200. Bearings nested with seals such as those illustrated in FIGS. 3-8 may be particularly useful in directional or horizontal drilling, where the roller cone drill bit often experiences higher loading stresses as described above than in vertical drilling.

Bearings nested with seals may be particularly useful in mitigating edge loading because the extended flange or bushing does not reduce the space available for a sealing system.

Figure 5:
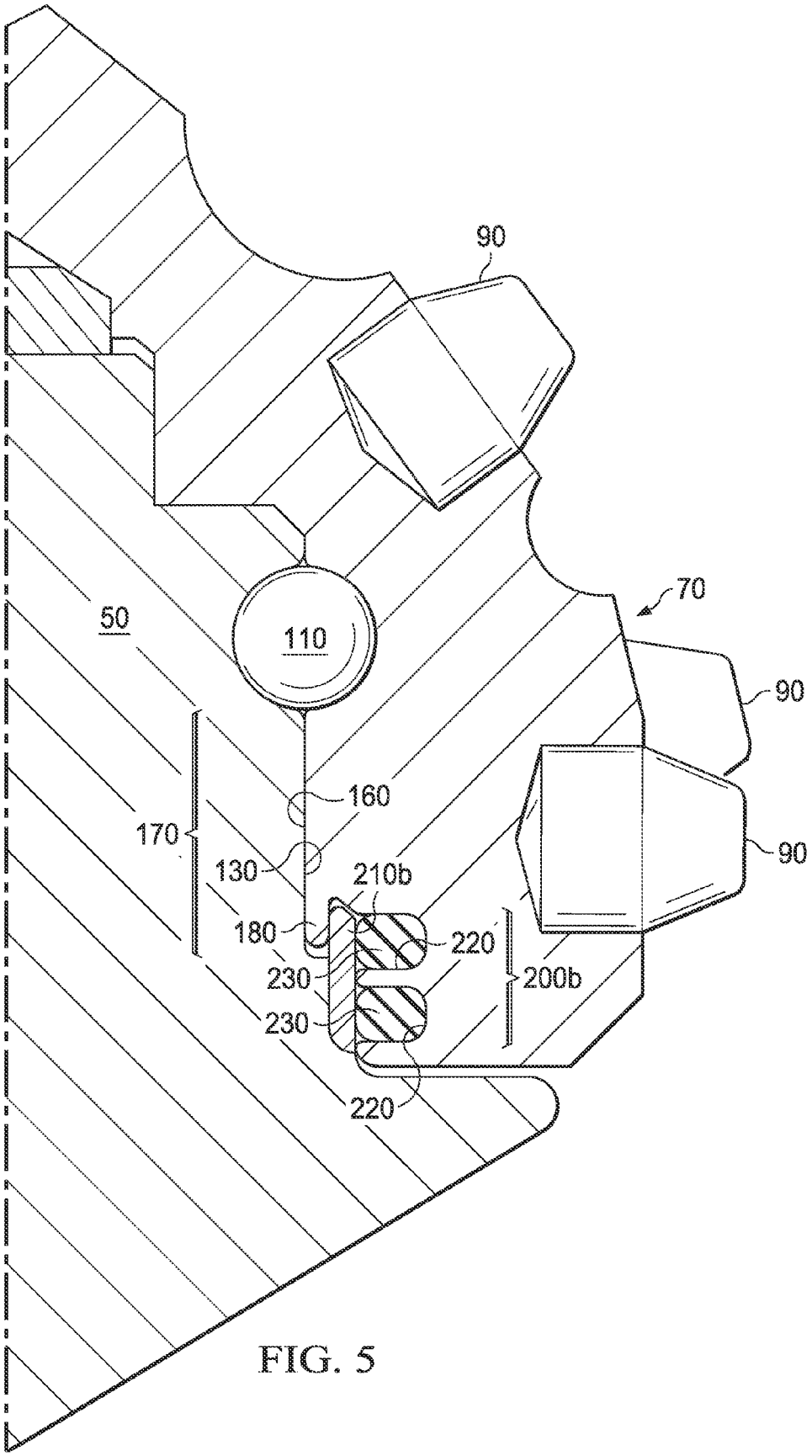
FIG. 5 is a schematic cross-section drawing of another a nested bearing and radial seal on a roller cone drill bit.
Figure 6:
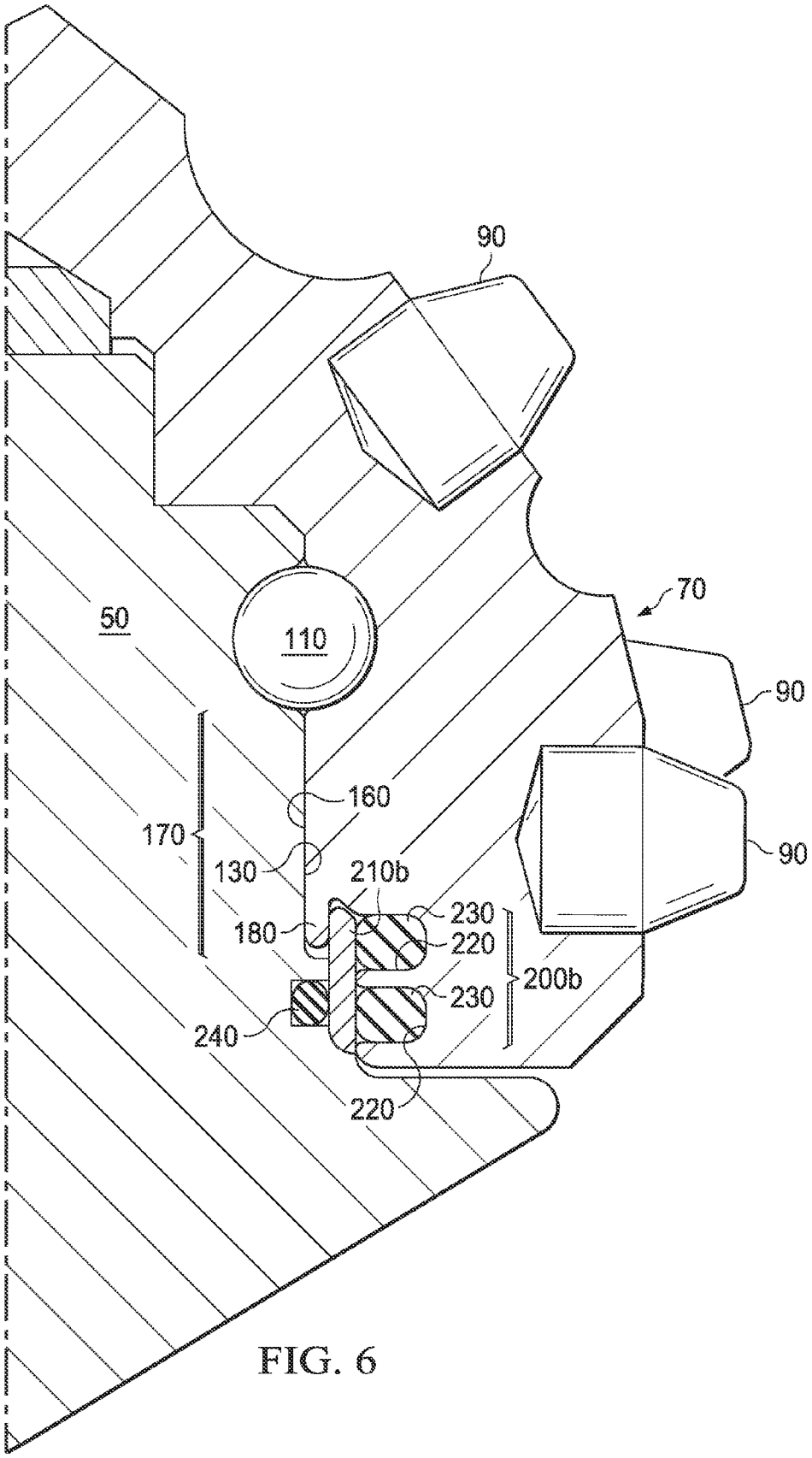
FIG. 6 is a schematic cross-section drawing of another a nested bearing and radial seal on a roller cone drill bit.
Figure 7:
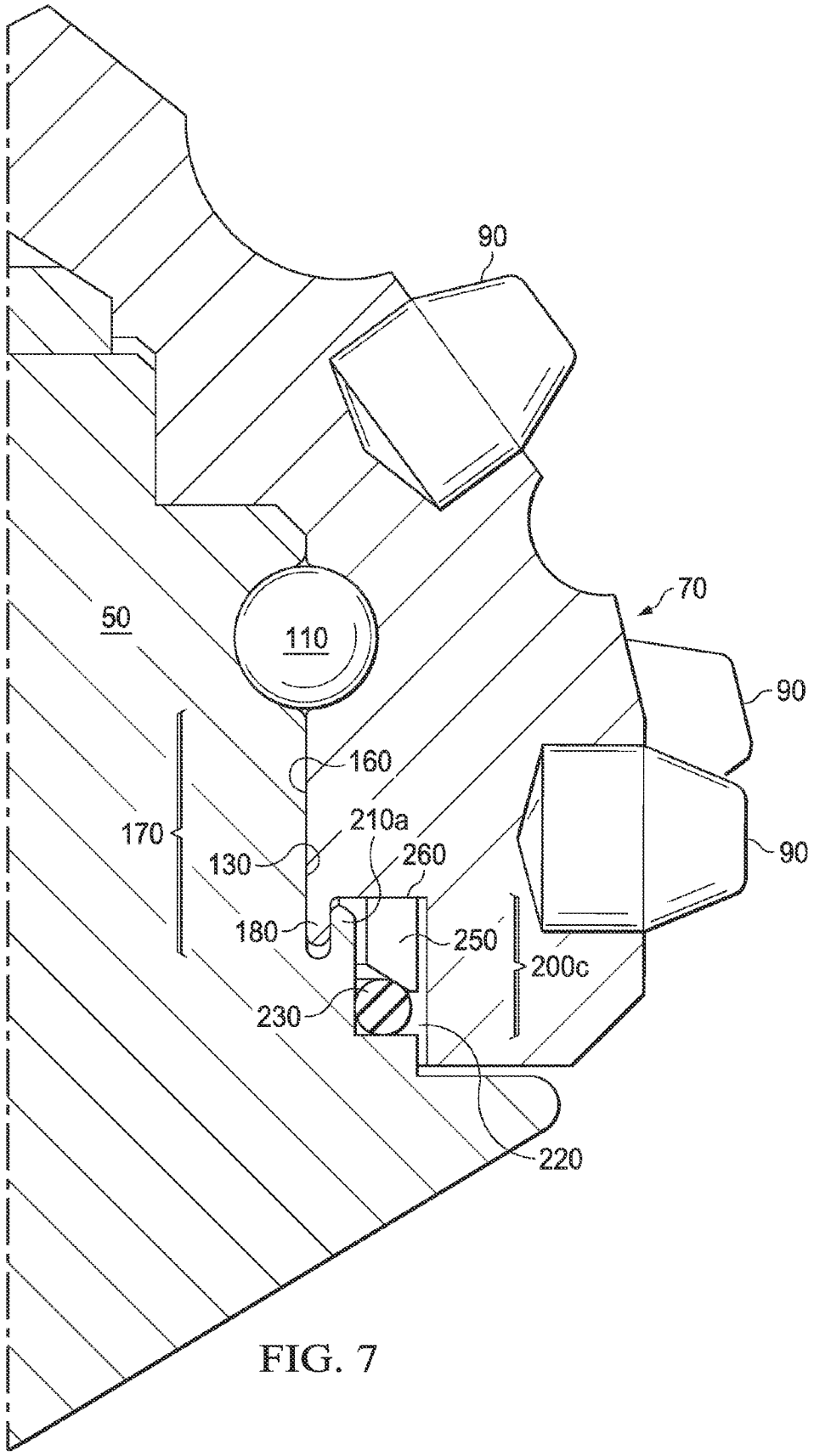
FIG. 7 a schematic cross-section drawing of a nested bearing and axial seal on a roller cone drill bit.
Figure 8:
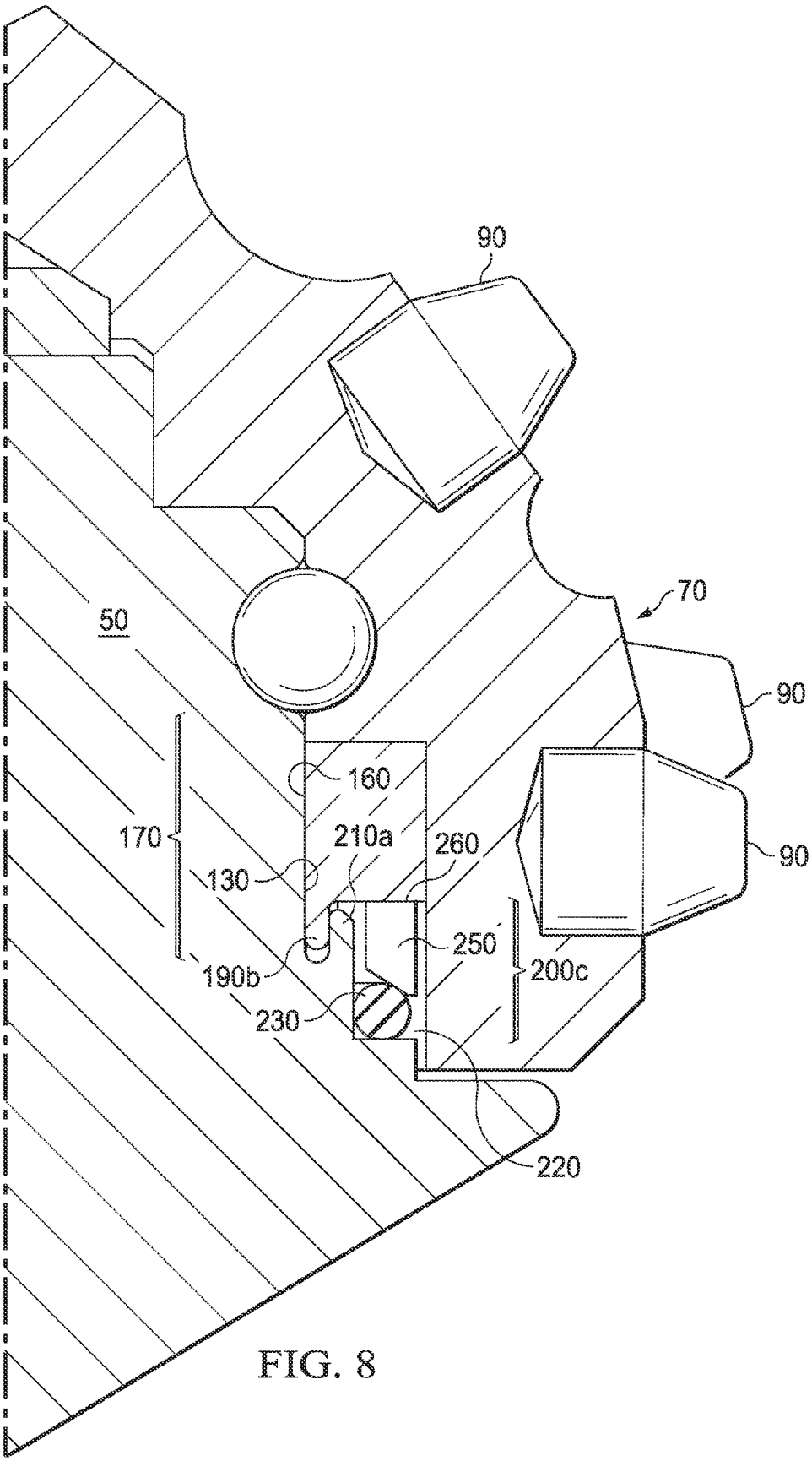
FIG. 8 is a schematic cross-section drawing of another nested bearing and axial seal on a roller cone drill bit.

FIGS. 3-8 are exploded views of area 300 in FIG. 2. FIGS. 3-6 show a double O-ring type seal 200*a* or 200*b*, while FIGS. 7-8 show a single static O-ring seal 230 energizing a mechanical seal. Single, double, or greater multiple O-ring seals may all be used by modifying the examples illustrated, using the teachings of present disclosure, to include greater or fewer seals and corresponding seal glands. Furthermore, although FIGS. 3-6 show—radial seals, the flanges, seal bosses, or bushing of FIGS. 3-6 may be used in connection with axial seals such as those illustrated in FIGS. 7-8 using the teachings of the present disclosure. Similarly, although FIGS. 7-8 show axial seals, the flanges, seal bosses, or bushings of FIGS. 7-8 may be used in connection with radial seals such as those illustrated in FIGS. 3-6 using the teachings of the present disclosure.

Furthermore, although O-ring seals are used for illustrative purposes if FIGS. 2-8, packing rings, ceramic seals, and metal-to-metal seals, or any other suitable type of seal or seal material, may be used in a nested structure based on the teachings of the present disclosure.

In addition, although FIGS. 3-8 show increased contact areas between bearing surfaces 130 and 160, the bearings and areas are not drawn to scale. Similarly, flanges, seal bosses and bushings are not drawn to scale in FIGS. 3-8. The dimensions of all of these elements may vary depending upon a variety of factors, such as the materials from which any bearings, bushings, flanges, seal bosses, or other bit components are formed, the methods used to manufacture any of these components, and the size of the bit.

Further, FIGS. 3-8 describe flanges 180, seal bosses 210*a* and 210*b*, and bushings 190*a*. The length of each of these, either absolutely or with respect to length of bearing 170 may be limited to optimize performance and avoid failure of flanges 180, seal bosses 210*a* and 210*b*, and/or bushings 190*a*. The respective lengths acceptable for a given drill bit may be determined by one of ordinary skill in the art with the assistance of this disclosure and may be affected by the thickness of flange 180, seal boss 210*a* or 210*b*, and/or bushing 190*a* and the materials from which it and/or bearing 170 are formed as well as stresses expected to be experienced during use of roller cone drill bit 10, among other factors. Flanges 180 and seal bosses 210*a* and 210*b* longer than 0.06", and especially longer than 0.12" may be difficult to machine.

Figure 4:
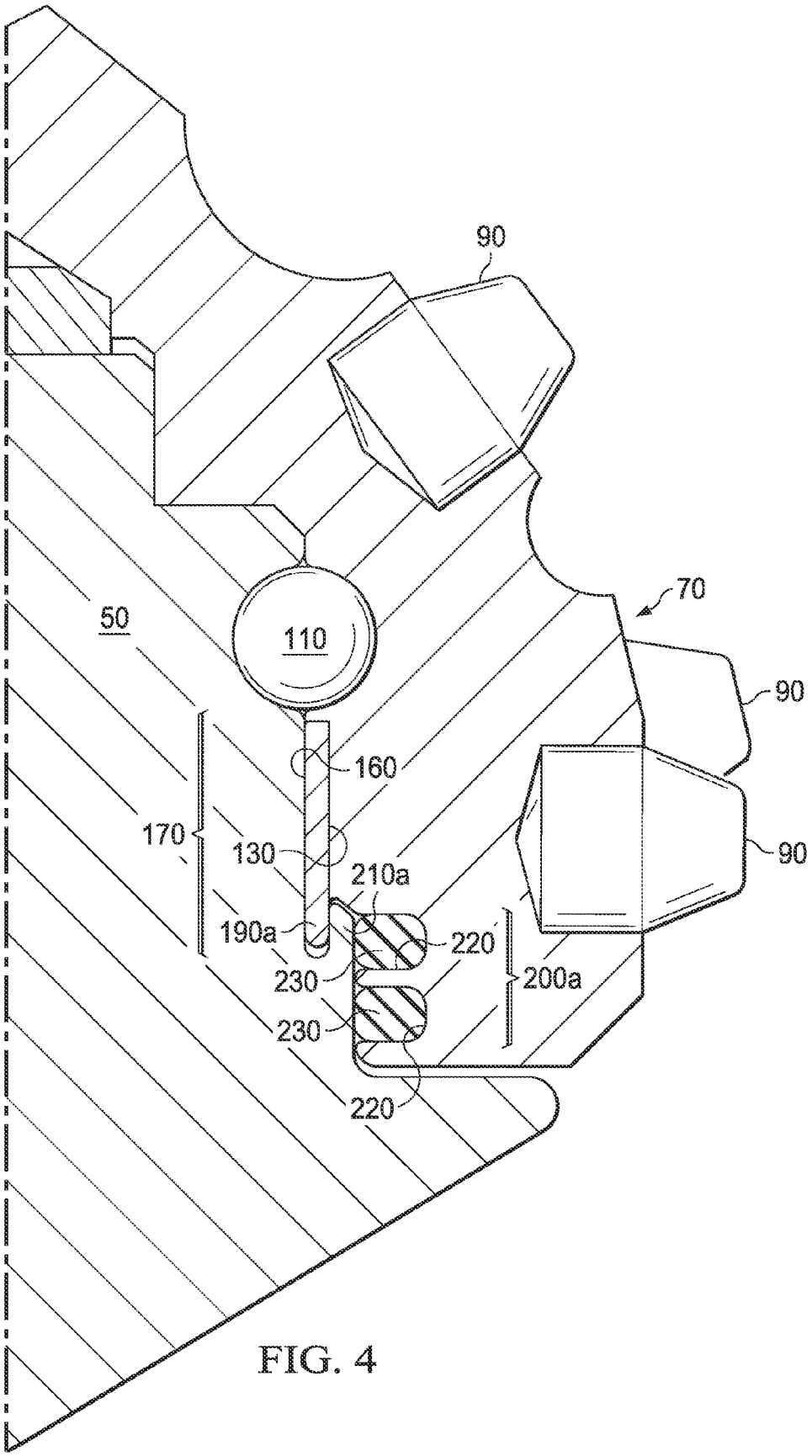
FIG. 4 is a schematic cross-section drawing of another a nested bearing and radial seal on a roller cone drill bit.

Finally, FIGS. 4 and 8 show two different bushing configurations, which may be used interchangeably.

Figure 3:
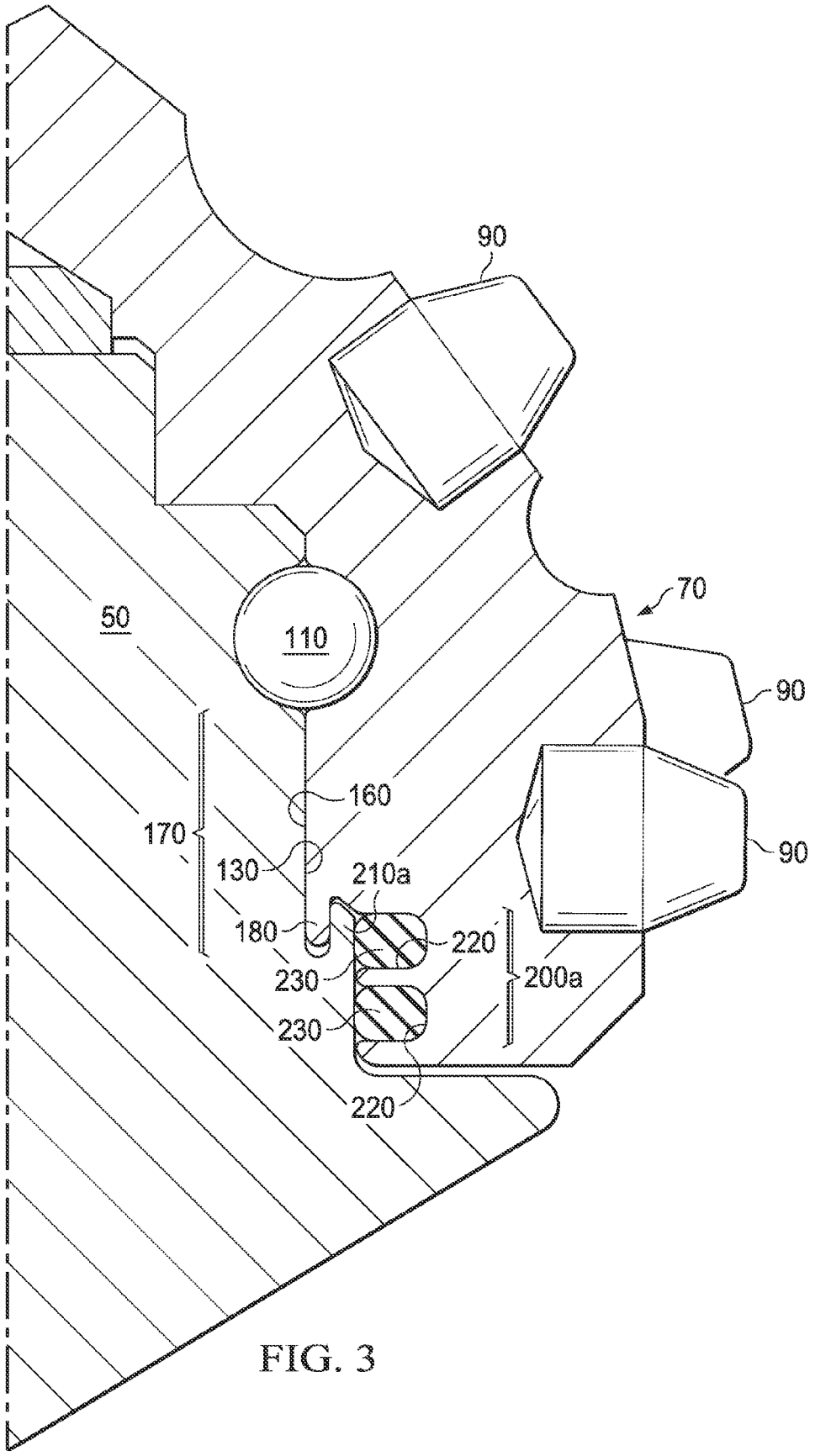
FIG. 3 is a schematic cross-section drawing of a nested bearing and radial seal on a roller cone drill bit.

FIG. 3 is a cross-sectional schematic drawing of cone assembly 70 rotatably mounted on spindle 50. Bearing 170 is formed in cone assembly 70 and spindle 50 and includes bearing surfaces 130 and 160, which support radial loads resulting from rotation of cone assembly 70 relative to spindle 50. Radial seal 200*a* includes two O-rings 230 located in two seal glands 220 and is also located between cone assembly 70 and spindle 50.

Radial seal 200*a* further includes seal boss 210*a*, which is located adjacent seal glands 220 and which retains O-rings 230 in seal glands 220. Seal boss 210*a* is shown in FIG. 3 covering the entirety of seal glands 220. Such a configuration is typically used to ensure that O-rings 230 remain in seal glands 220, but configurations in which seal boss 210*a* covers only part of one or more seal glands 220, such that O-rings 230 may nevertheless not extrude from seal glands 220, are possible. As illustrated, seal boss 210*a* extends partially over a contact area where bearing surfaces 130 and 160 are in contact with one another. This extension is made possible by flange 180, which nests with seal boss 210*a* by extending into a gap formed between bearing surface 130 and seal boss 210*a* and increases the overall length of the contact area between bearing surfaces 130 and 160 as compared to what it would be in a similar drill bit with a seal boss that did not nest with a flange.

Flange 180 and/or seal boss 210*a* may be machined into spindle 50 or cone assembly 70 or components thereof. Alternatively, they may be introduced by molding or other mechanical or chemical process for the removal of materials. The maximum lengths of flange 180 and seal boss 210*a* may be dictated by manufacturing methods, their respective thicknesses, and the materials from which they are formed.

FIG. 4 is a cross-sectional schematic drawing of cone assembly 70 rotatably mounted on spindle 50. Bearing 170 is formed in cone assembly 70 and spindle 50 and includes bearing surfaces 130 and 160, which support radial loads resulting from rotation of cone assembly 70 relative to spindle 50. Bearing surface 130 is located on bushing 190*a*, which is part of bearing 170 and rests on spindle 50. Radial seal 200*a* includes two O-rings 230 located in two seal glands 220 and is also located between cone assembly 70 and spindle 50.

Radial seal 200*a* further includes seal boss 210*a*, which is located adjacent seal glands 220 and which retains O-rings 230 in seal glands 220. Seal boss 210*a* is shown in FIG. 4 covering the entirety of seal glands 220. Such a configuration is typically used to ensure that O-rings 230 remain in seal glands 220, but configurations in which seal boss 210*a* covers only part of one or more seal glands 220, such that O-rings 230 may nevertheless not extrude from seal glands 220, are possible. As illustrated, seal boss 210*a* extends partially over a contact area, where bearing surfaces 130 and 160 are in contact with one another. This extension is made possible by bushing 190*a*, which nests with seal boss 210*a* by extending into a gap formed between bearing surface 130 and seal boss 210*a* and increases the overall area of the contact area between bearing surfaces 130 and 160 as compared to what it would be in a similar drill bit with a seal boss that did not nest with a bushing.

Bushing 190*a* is not integral with cone bearing 170 and may be formed from a different material than bearing 170 or spindle 50. For instance, bushing 190*a* may be formed from beryllium copper (BeCu), spinodal Cu alloys, or any other appropriate material. Bushing 190*a* may be manufactured using any suitable techniques, including conventional techniques, and may be inserted in bearing 170 during manufacture of bit 10, particularly before or during placement of cone assembly 70 on spindle 50. Bushing 190*a* may be free-floating or partially or wholly secured to the portion of bearing 170. Because bushing 190*a* may be formed separately from bearing 170 or from a different material than bearing 170 or spindle 50, it may be able to provide a longer nesting with seal boss 210*a* than flange 180 as shown in FIG. 3 or a similar flange because bushing 190*a* is not subjected to stresses or limitations imposed by machining, molding, or casting cone or spindle material. Bushing 190*a* may also be thinner than flange 180 as shown in FIG. 3 or a similar flange for the same reasons. Additionally, because bushing 190*a* may be free-floating or only partially secured to bearing 170 and may be formed from a different material than bearing 170 or spindle 50, it may be better able to deform in response to contact stresses than flange 180 or a similar flange and/or have better wear and/or or anti-galling properties than the cone or spindle materials.

Seal boss 210*a* may be formed and its dimensions may be dictated as described above and with respect to FIG. 3.

FIG. 5 is a cross-sectional schematic drawing of cone assembly 70 rotatably mounted on spindle 50. Bearing 170 is formed in cone assembly 70 and spindle 50 and includes bearing surfaces 130 and 160, which support radial loads resulting from rotation of cone assembly 70 relative to spindle 50. radial seal 200*b* includes two O-rings 230 located in two seal glands 220 and is also located between cone assembly 70 and spindle 50.

Radial seal 200*b* further includes seal boss 210*b*, which is not integral with spindle 50 and may be formed from a different material than spindle 50. Seal boss 210*b* may be formed from a material having enhanced properties, such as enhanced mechanical or seal properties, as compared to seal boss 210*a* as shown in FIGS. 3 and 4, or a similar seal boss that is integral with spindle 50 and formed from the same material as spindle 5. Seal boss 210*b* may be manufactured using any suitable techniques, including conventional techniques, and may be inserted in bearing 170 during manufacture of bit 10, particularly before or during placement of cone assembly 70 on spindle 50.

Seal boss 210*b* may be fixed to spindle 50, for example by press fit, shrink fit or using an adhesive or attachment material. Seal boss 210*b* is shown in FIG. 5 covering the entirety of seal glands 220. Such a configuration is typically used to ensure that O-rings 230 remain in seal glands 220, but configurations in which seal boss 210*b* covers only part of one or more seal glands 220, such that O-rings 230 may nevertheless not extrude from seal glands 220, are possible. As illustrated, seal boss 210*b* extends partially over a contact area, where bearing surfaces 130 and 160 are in contact with one another. This extension is made possible by flange 180, which nests with seal boss 210*b* by extending into a gap formed between bearing surface 130 and seal boss 210*b* and increases the overall area of the contact area between bearing surfaces 130 and 160 as compared to what it would be in a similar drill bit with a seal boss that did not nest with a bushing. Because seal boss 210*b* may be formed separately from or from a different material than spindle 50, seal boss 210*b* may extend further from spindle 50 than seal boss 210*a* shown in FIGS. 3 and 4, and thus the gap formed between bearing surface 130 and seal boss 210*b* may be deeper. This may provide a greater contact area between flange 180 and bearing surface 130 than seal boss 210*a* as shown in FIGS. 3 and 4, or a similar seal boss because seal boss 210*b* is not subjected to stresses or limitations imposed by machining or molding spindle material. Seal boss 210*b* may also be thinner than seal boss 210*a* as shown in FIGS. 3 and 4, or a similar seal boss for the same reasons.

Flange 180 may be formed and its dimensions may be dictated as described above and with respect to FIG. 3.

Although not expressly shown, a drill bit 10 may also contain a seal boss such as seal boss 210*b* used in conjunction with a bushing such as bushing 190*a*.

FIG. 6 is a cross-sectional schematic drawing of a cone assembly 70 rotatably mounted on spindle 50 in a manner similar to that described with respect to FIG. 5. However, in FIG. 6, O-ring 240 is further provided in spindle 50 on the side of seal boss 210*b* opposite seal glands 220 and O-rings 230. O-ring 240 experts pressure on seal boss 210*b*, ensuring that the interface between the spindle 50 and seal boss 210*b* is sealed. In this configuration the seal boss 210*b* may be fixed to the spindle in a manner similar to that described with respect to FIG. 5 or allowed to float with respect to the opposing spindle 50 surface.

FIG. 7 is a cross-sectional schematic drawing of cone assembly 70 rotatably mounted on spindle 50. Bearing 170 is formed in cone assembly 70 and spindle 50 and includes bearing surfaces 130 and 160, which support radial loads resulting from rotation of cone assembly 70 relative to spindle 50. Axial seal 200*c* is also located between cone assembly 70 and spindle 50. Axial seal 200*c* includes an O-ring 230 located in a seal gland 220 and further includes a mechanical seal 250, which exerts axial pressure on seal face 260, which, as depicted, is a dynamic sealing face. When O-ring seal 230 is compressed between the seal boss 210*a* and the mechanical seal 250 it seals the gap between the seal boss 210*a* and the mechanical seal 250 and energizes mechanical seal 250 against the dynamical sealing face 260.

Axial seal 200*c* further includes seal boss 210*a*, which is located adjacent seal gland 220 and which retains O-ring 230 in seal gland 220. Seal boss 210*a* is shown in FIG. 7 covering the entire portion of seal gland 220 from which O-ring 230 might extrude. Such a configuration is typically used to ensure that O-ring 230 remains in seal gland 220. As illustrated, seal boss 210*a* extends partially over a contact area, where bearing surfaces 130 and 160 are in contact with one another. This extension is made possible by flange 180, which nests with seal boss 210*a* by extending into a gap formed between bearing surface 130 and seal boss 210*a* and increases the overall area of the contact area between bearing surfaces 130 and 160 as compared to what it would be in a similar drill bit with a seal boss that did not nest with a flange.

Flange 180 and/or seal boss 210*a* may be machined into spindle 50 or components thereof. Alternatively, they may be introduced by molding or other mechanical or chemical process for the removal of materials. The maximum lengths of flange 180 and seal boss 210*a* may be dictated by manufacturing methods, their respective thicknesses, and the materials from which they are formed. Seal boss 210*a* may also be formed from a different material and positioned on spindle 50 in a manner similar to those described in reference to FIG. 5 and FIG. 6.

FIG. 8 is a cross-sectional schematic drawing of cone assembly 70 rotatably mounted on spindle 50. Bearing 170 is formed in cone assembly 70 and spindle 50 and includes bearing surfaces 130 and 160, which support radial loads resulting from rotation of cone assembly 70 relative to spindle 50. Bearing surface 130 is located on bushing 190*b*, which is part of cone assembly 70 and rests on cone assembly 70. Axial seal 200*c* is also located between cone assembly 70 and spindle 50. Axial seal 200*c* includes an O-ring 230 located in a seal gland 220 and further includes a shaft 250, which exerts axial pressure on seal face 160, which is depicted as a dynamic seal face. When O-ring seal 230 is compressed between the seal boss 210*a* and the mechanical seal 250 it seals the gap between the seal boss 210*a* and the mechanical seal 250 and energizes mechanical seal 250 against the dynamical sealing face 260.

Axial seal 200*c* further includes seal boss 210*a*, which is located adjacent seal gland 220 and which retains O-ring 230 in seal gland 220. Seal boss 210*a* is shown in FIG. 8 covering the entire portion of seal gland 220 from which O-ring 230 might extrude. Such a configuration is typically used to ensure that O-ring 230 remains in seal gland 220. As illustrated, seal boss 210*a* extends partially over a contact area, where bearing surfaces 130 and 160 are in contact with one another. This extension is made possible by bushing 190*b*, which nests with seal boss 210*a* by extending into a gap formed between bearing surface 130 and seal boss 210*a* and increases the overall area of contact area between bearing surfaces 130 and 160 as compared to what it would be in a similar drill bit with a seal boss that did not nest with a bushing.

Bushing 190*b* is not integral with cone assembly 90 or bearing 170 and may be formed from a different material than cone assembly 90 or bearing 170. For instance, bushing 190*b* may be formed from beryllium copper (BeCu), spinodal Cu alloys, or any other appropriate material. Bushing 190*b* may be manufactured using any suitable techniques, including conventional techniques, and may be inserted in bearing 170 during manufacture of bit 10, particularly before or during placement of cone assembly 70 on spindle 50. Bushing 190*b* may be partially or wholly secured to the portion of bearing 170 located in cone assembly 70 or bushing 190*b* may be partially or wholly secured to another portion of cone assembly 90. Recess 270 in cone assembly 90 may further provide structural and mechanical support to bushing 190*b* and may, for example, help avoid slippage of bushing 190*b* in response to forces exerted upon it during use of drill bit 10. Because bushing 190*b* may be formed separately from bearing 170 or from a different material than cone assembly 70, it may be able to provide a longer nesting with seal boss 210*a* than flange 180 as shown in FIG. 7 or a similar flange because bushing 190*b* is not subjected to stresses or limitations imposed by machining or molding cone assembly material. Bushing 190*b* may also be thinner than flange 180 as shown in FIG. 7 or a similar flange for the same reasons. Additionally, because bushing 190*b* may be formed from a different material than bearing 170 or cone assembly 70, it may be better able to deform in response to contact stresses than flange 180 or a similar flange.

Seal boss 210*a* may be formed and its dimensions may be dictated as described above with respect to FIG. 7.

FIG. 9 is a schematic drawing in elevation and in section with portions broken away of wellbores or boreholes which may be formed in a formation by roller cone drill bits incorporating teachings of the present disclosure. Various aspects of the present disclosure may be described with respect to a drilling rig located at well surface 410. Various types of drilling equipment such as a rotary table, mud pumps and mud tanks (not expressly shown) may be located at well surface 410. The drilling rig may have various characteristics and features associated with a land drilling rig. However, roller cone drill bits incorporating teachings of the present disclosure may be satisfactorily used with drilling equipment located on offshore platforms, drill ships, semi-submersibles and drilling barges (not expressly shown).

FIG. 10 is a schematic drawing in section and in elevation with portions broken away showing the drill string and attached roller cone drill bit of FIG. 9 adjacent to the bottom of a wellbore Referring to FIGS. 9 and 10, roller cone drill bit 10 may be attached with the end of drill string 420 extending from well surface 410. Drill string 420 may apply weight to and rotate roller cone drill bit 10 to form wellbore 430. Drill string 420 may be formed from sections or joints of generally hollow, tubular drill pipe (not expressly shown). Drill string 420 may also include bottom hole assembly 440 formed from a wide variety of components.

Drill string 420 and roller cone drill bit 10 may be used to form various types of wellbores and/or boreholes. For example, horizontal wellbore 430 as shown in FIG. 9 in dotted lines, may be formed using drill string 420 and roller cone drill bit 10.

The present disclosure is not limited to roller cone drill bits associated with conventional drill strings. In addition, although FIGS. 1-10 illustrate a drill bit having only cone assemblies 70, the present disclosure may also be used in hybrid bits which combine both cone assemblies and fixed cutters and/or blades.

The present disclosure provides an embodiment A relating to drill bit bearing assembly including a spindle, a cone assembly rotatably mounted on the spindle, a seal located between the spindle and cone assembly, the seal including a seal boss associated with the spindle, and a bearing formed from at least a portion of the spindle and at least a portion of the cone assembly, the bearing including a first bearing surface defined by the spindle, a second bearing surface defined by the cone assembly, and a bearing member co-extensive with the first bearing surface or the second bearing surface and extending into a gap formed between the first bearing surface and the seal boss.

The present disclosure also provides an embodiment B relating to a drill bit including at least one arm including the drill bit bearing assembly of embodiment A.

The present disclosure also provides an embodiment C relating to a method of drilling a wellbore by rotating a drill bit of embodiment B and engaging a formation with the cone assembly of the drill bit to form a wellbore in the formation. In addition, embodiments A, B and C may be used in conjunction with the following additional elements, which may also be combined with one another unless clearly mutually exclusive: i) the bearing member includes a flange extending into a gap formed between the first bearing surface and the seal boss, ii) the bearing member includes a bushing extending into a gap formed between the first bearing surface and the seal boss, iii) the seal boos is not integral with the bushing; iv) the seal is an axial seal; v) the seal is a radial seal; vi) the seal includes an O-ring seal, a packing ring seal, a ceramic seal, a metal-to-metal seal, or any combination thereof, vii) the seal boss is not integral with the spindle; viii) the bearing further comprising an O-ring provided in the spindle; ix) the bit includes a lubricant retained within the bit by the seal; x) the bearing member distributes contact stresses during use of the bit to drill a wellbore; xi) the drill bit is a hybrid drill bit and further comprises at least one blade or fixed cutter; and xii) the wellbore includes a directional or horizontal wellbore and engaging the formation includes engaging the formation at an angle other than vertical with respect to a well surface.

Although the present disclosure and its advantages have been described in detail, it should be understood that various changes, substitutions and alternations can be made herein without departing from the spirit and scope of the disclosure as defined by the following claims. For example, one of ordinary skill in the art may be able to apply similar structures to other bearings experiencing similar edge loading or other conditions, particularly other bearing used in downhole tools. In addition, although the bearings discussed herein include flanges and bushings, other members extending under the seal or seal boss in a nested fashion may also be used. Furthermore, the relative positions of the seal and bearing with respect to the spindle and cone may be reversed.

The invention claimed is:

1. A drill bit bearing assembly comprising:
- a spindle;
- a cone assembly rotatably mounted on the spindle;
- a seal located between the spindle and cone assembly, the seal comprising a seal boss associated with the spindle; and
- a bearing formed from at least a portion of the spindle and at least a portion of the cone assembly, the bearing comprising:
  - a first bearing surface defined by the spindle;
  - a second bearing surface defined by the cone assembly;
  - a bearing member nested with the seal boss and co-extensive with the first bearing surface or the second bearing surface and extending into a gap formed between the first bearing surface and the seal boss.

2. The bearing assembly of claim 1, wherein the bearing member comprises a flange extending into a gap formed between the first bearing surface and the seal boss.

3. The bearing assembly of claim 1, wherein the bearing member comprises a bushing extending into a gap formed between the first bearing surface and the seal boss.

4. The bearing assembly of claim 1, wherein the seal boss is not integral with a bushing.

5. The bearing assembly of claim 1, wherein the seal is an axial seal.

6. The bearing assembly of claim 1, wherein the seal is a radial seal.

7. The bearing assembly of claim 1, wherein the seal comprises an O-ring seal, a packing ring seal, a ceramic seal, a metal-to-metal seal, or any combination thereof.

8. The bearing assembly of claim 1, wherein the seal boss is not integral with the spindle.

9. A drill bit comprising:
- at least one arm comprising:
  - a spindle;
- a cone assembly rotatably mounted on the spindle;
- a seal located between the spindle and cone assembly, the seal comprising a seal boss associated with the spindle; and
- a bearing formed from at least a portion of the spindle and at least a portion of the cone assembly, the bearing comprising:
  - a first bearing surface defined by the spindle;
  - a second bearing surface defined by the cone assembly;
  - a bearing member nested with the seal boss and co-extensive with the first bearing surface or the second bearing surface and extending into a gap formed between the first bearing surface and the seal boss.

10. The drill bit of claim 9, wherein the bearing member comprises a flange extending into a gap formed between the first bearing surface and the seal boss.

11. The drill bit of claim 9, wherein the bearing member comprises a bushing extending into a gap formed between the first bearing surface and the seal boss.

12. The drill bit of claim 9, wherein the seal boss is not integral with a bushing.

13. The drill bit of claim 9, wherein the seal is an axial seal.

14. The drill bit of claim 9, wherein the seal is a radial seal.

15. The drill bit of claim 9, wherein the seal comprises an O-ring seal, a packing ring seal, a ceramic seal, a metal-to-metal seal, or any combination thereof.

16. The drill bit of claim 9, wherein the seal boss is not integral with the spindle.

17. The drill bit of claim 16, further comprising an O-ring provided in the spindle.

18. The drill bit of claim 9, further comprising a lubricant retained within the bit by the seal.

19. The drill bit of claim 9, wherein the bearing member distributes contact stresses during use of the bit to drill a wellbore.

20. The drill bit of claim 9, wherein the drill bit is a hybrid drill bit and further comprises at least one blade or fixed cutter.

* * * * *